US008419358B2

(12) United States Patent
Hunjan et al.

(10) Patent No.: US 8,419,358 B2
(45) Date of Patent: Apr. 16, 2013

(54) FLOW OUTPUT NOZZLE FOR CENTRIFUGAL PUMP

(75) Inventors: Harjit S. Hunjan, Larkspur, CO (US); Michael S. Burton, Louisville, CO (US)

(73) Assignee: Sundyne, LLC, Arvada, CO (US)

( * ) Notice: Subject to any disclaimer, the term of this patent is extended or adjusted under 35 U.S.C. 154(b) by 494 days.

(21) Appl. No.: 12/485,991

(22) Filed: Jun. 17, 2009

(65) Prior Publication Data

US 2010/0322761 A1 Dec. 23, 2010

(51) Int. Cl.
*F04D 29/44* (2006.01)

(52) U.S. Cl.
USPC ..... 415/196; 415/206; 415/207; 415/212.1

(58) Field of Classification Search ..... 415/196, 415/206, 207, 212.1, 225, 197
See application file for complete search history.

(56) References Cited

U.S. PATENT DOCUMENTS

| | | | | |
|---|---|---|---|---|
| 1,914,919 | A | | 6/1933 | Heeermans |
| 1,929,496 | A | * | 10/1933 | Jacuzzi ..... 415/200 |
| 2,144,417 | A | | 1/1939 | Schneible |
| 2,268,358 | A | * | 12/1941 | Turner ..... 415/204 |
| 3,071,077 | A | | 1/1963 | Hornschuch et al. |
| 3,131,642 | A | * | 5/1964 | Geer et al. ..... 415/196 |
| 3,162,135 | A | * | 12/1964 | Nichols et al. ..... 415/196 |
| 3,647,314 | A | * | 3/1972 | Laessig ..... 415/206 |
| 3,692,426 | A | | 9/1972 | Ryall et al. |
| 4,389,159 | A | | 6/1983 | Sarvanne |
| 4,844,693 | A | | 7/1989 | Grzina |
| 5,044,882 | A | | 9/1991 | Akamatsu |

OTHER PUBLICATIONS

International Preliminary Report mailed Aug. 23, 2011. PCT/US2010/033826.
PCT International Search Report and Written Opinion, mailed Oct. 11, 2010, PCT International Application No. PCT/US2010/033826.

* cited by examiner

*Primary Examiner* — Edward Look
*Assistant Examiner* — Jason Davis
(74) *Attorney, Agent, or Firm* — Carlson, Gaskey & Olds, PC

(57) ABSTRACT

A flow outlet for a pump includes a pocket section which defines a pocket section diameter. A throat section downstream of the pocket section, the throat section defines a throat section diameter less than the pocket section diameter.

24 Claims, 6 Drawing Sheets

FLOW OUTPUT NOZZLE FOR CENTRIFUGAL PUMP

BACKGROUND

The present disclosure relates to a centrifugal pump, and more particularly to an output nozzle which provides stable Head vs. Flow performance at shut-off.

Most centrifugal pumps have a Head vs. Flow curve that tends to flatten out or droop at low flows. This effect becomes more pronounced at shut-off or zero-flow and results in an unstable curve.

Unstable, i.e. droopy or flat, Head vs. Flow performance may complicate operation as slight changes in system resistance may result in large flow variations and/or cause the pump equipment to operate at an unacceptable flow point.

SUMMARY

A flow outlet for a pump according to an exemplary aspect of the present disclosure includes a pocket section which defines a pocket section diameter. A throat section downstream of the pocket section, the throat section defines a throat section diameter less than the pocket section diameter.

A centrifugal pump according to an exemplary aspect of the present disclosure includes a housing which defines a collector. An impeller within the collector, the impeller defined along an axis of rotation. A pocket section adjacent to the collector, the pocket section defines a pocket section diameter. A throat section downstream of the pocket section, the throat section defines a throat section diameter less than the pocket section diameter.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
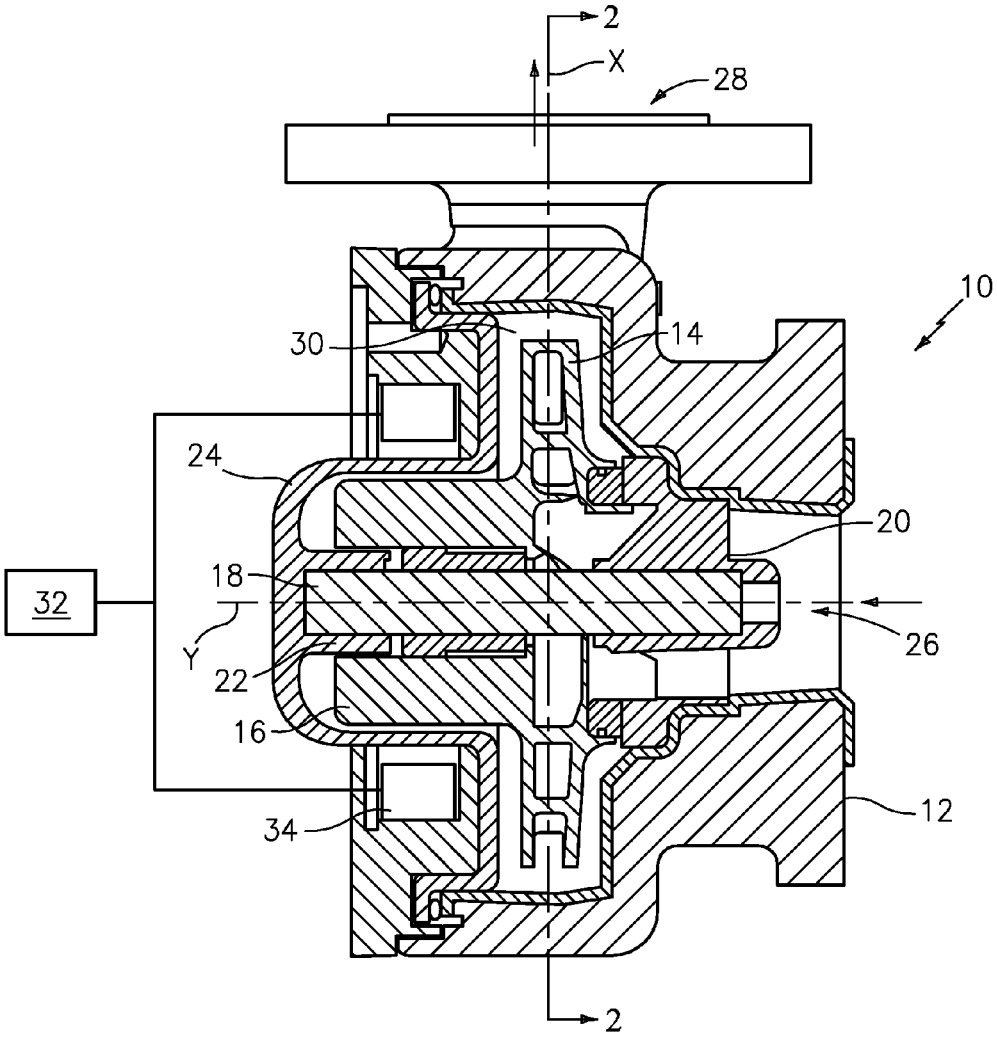
FIG. 1 is a general longitudinal sectional view of a centrifugal pump assembly for use with the present disclosure.

FIG. 1 schematically illustrates a centrifugal pump assembly 10. Although a magnetically driven centrifugal pump assembly 10 is illustrated in the disclosed non-limiting embodiment it should be understood that various pumps will benefit from the disclosure herein.

The pump assembly 10 generally includes a housing 12, an impeller 14, an inner magnet assembly 16, a shaft 18, shaft supports 20, 22, and a containment shell 24. A flow inlet 26 defines an axis Y and is formed by an annulus about the shaft 18 and the front shaft support 20 (FIG. 2) about which the impeller 14 rotates. A flow outlet 28 defines an axis X transverse to the axis Y and is formed as a tangential passage to a collector 30 formed within the housing 12 which contains the impeller 14 such that the flow outlet 28 is in communication with the impeller 14.

In operation, a motor 32 powers an outer magnet assembly 34 to thereby cause rotation of the impeller 14 within housing 12 due to a magnetic response of the inner magnet assembly 16. Magnetically driven centrifugal pumps are well suited for pumping, for example, corrosive type fluids because the pump assembly minimizes seal requirements.

Figure 2:
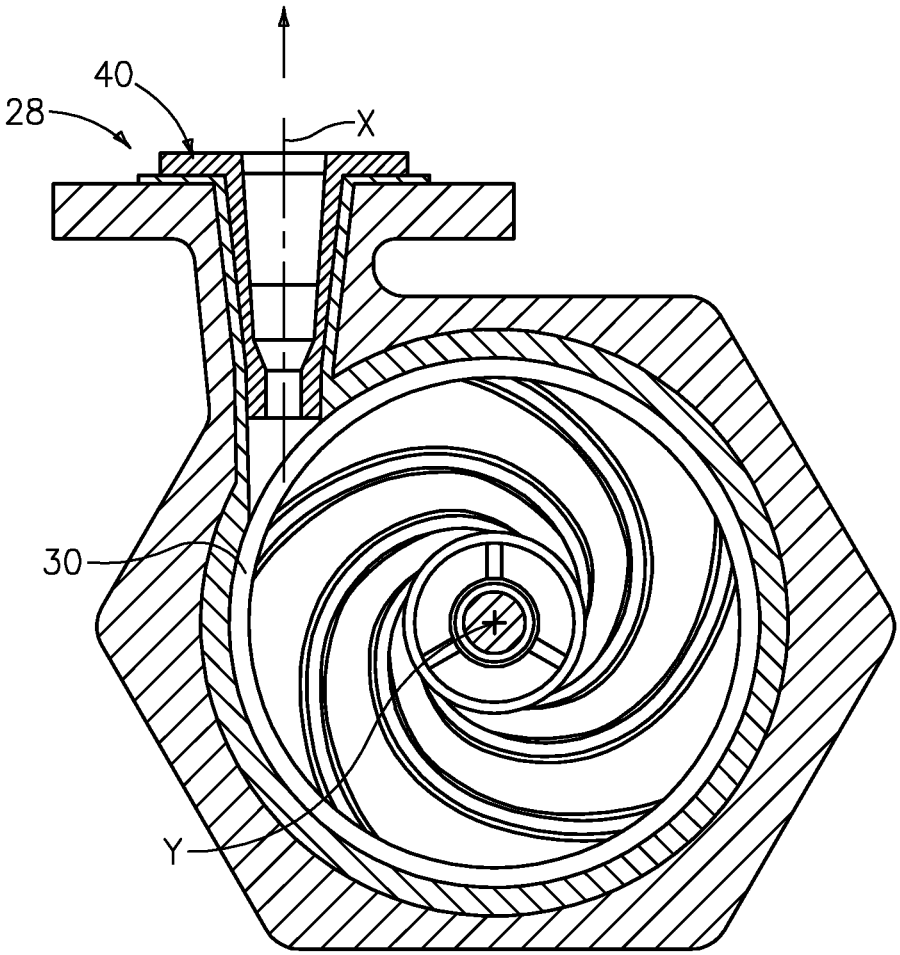
FIG. 2 is a general lateral sectional view of the centrifugal pump assembly of FIG. 1 taken along line 2-2 which illustrates a nozzle according to the present disclosure.
Figure 3:
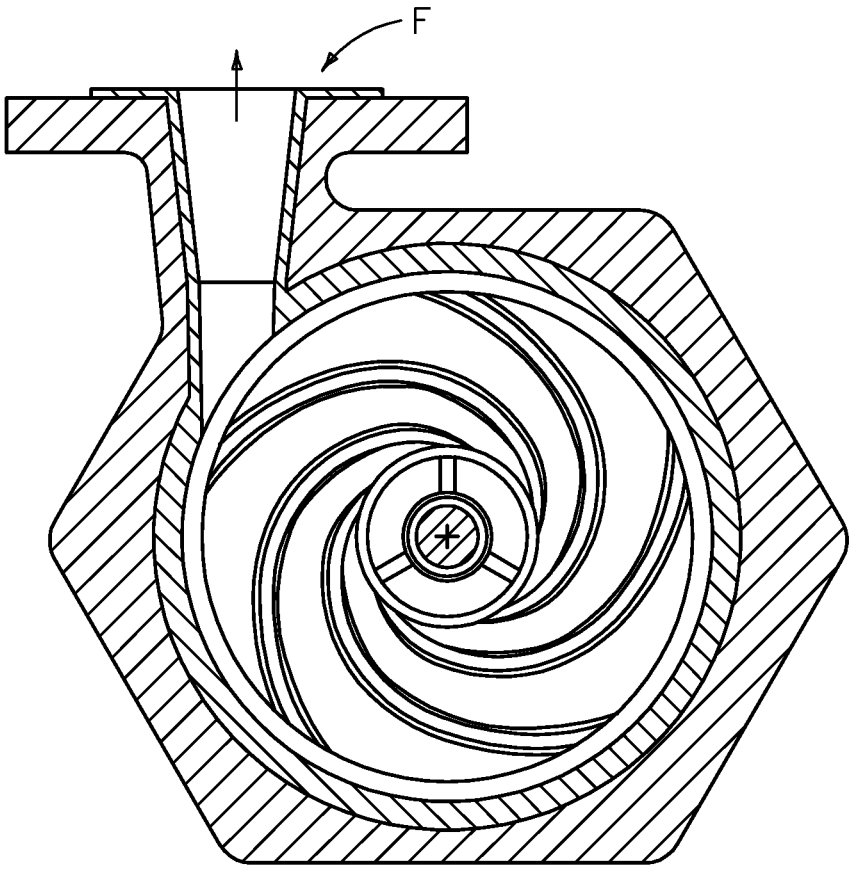
FIG. 3 (RELATED ART)
FIG. 3 is a general lateral sectional view of a centrifugal pump assembly illustrating a RELATED ART nozzle according to the present disclosure.

Referring to FIG. 2, the flow outlet 28 includes a nozzle 40. Although the nozzle 40 is illustrated as a separate component in the disclosed, non-limiting embodiment, it should be understood that the nozzle 40 may alternatively be integrally machined and/or formed in the flow outlet 28. The nozzle 40 forms an interior shape which advantageously provides a rising Head vs. Flow curve to shut-off as compared to a current art flow outlet F (related art; FIG. 3)

Figure 4A:
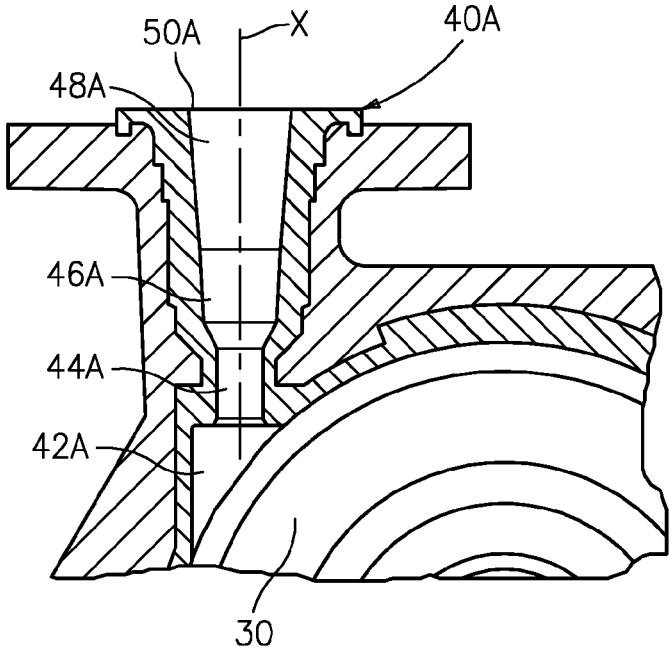
FIG. 4A is a partial lateral sectional view of a centrifugal pump assembly illustrating one non-limiting embodiment of a nozzle according to the present disclosure.

Referring to FIG. 4A, the nozzle 40, in one non-limiting embodiment, may be a nozzle 40A which generally includes a pocket section 42A, a throat section 44A, a transition section 46A and a diffuser section 48A along axis X.

Figure 4B:
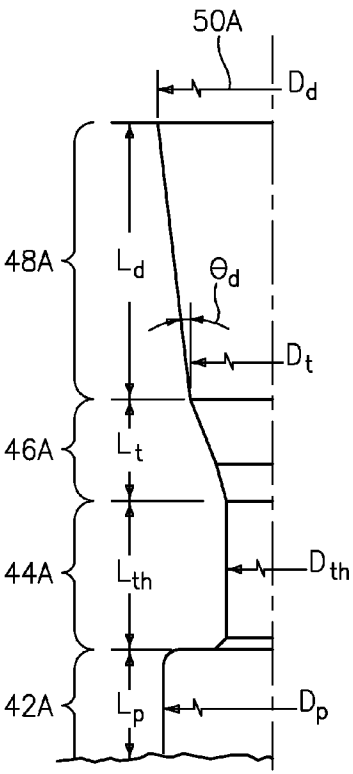
FIG. 4B is an expanded lateral sectional view of the nozzle illustrated in FIG. 4A.

Referring to FIG. 4B, the pocket section 42A generally defines a diameter $D_p$, the throat section 44A generally defines a diameter $D_{th}$, the transition section 46A generally defines a diameter $D_t$ and the diffuser section 48A generally defines discharge diameter $D_d$.

The pocket section 42A may be formed within the flow outlet 28 upstream of the throat section 44A. The pocket section, in one non-limiting embodiment may be a portion of the housing 12 which receives the separate nozzle 40A. That is, the nozzle 40A is manufactured separately from the housing 12.

The nozzle 40A defines a discharge 50A at a downstream end of the nozzle 40. The throat section 44A is generally cylindrical and is of a diameter less than the pocket section 42A. The throat section 44A is in communication with the transition section 46A. The transition section 46A may be a relatively short, frusto-conical shape in communication with the diffuser section 48A. The diffuser section 48A may be a relatively long frusto-conical shape.

The nozzle 40 configuration allows for pressure recovery at the discharge 50A as long as flow is established. But at low or zero flow there is little, if any, pressure recovery which may otherwise result in the type of droopy head v. flow curve of conventional related art designs (FIG. 3) as represented by the Total Dynamic Head (TDH)/Flow curves. By displacing the throat section 44A back into the flow outlet 28 discharge passage away from the impeller 14, coupled with the diffuser section 48A, an advantageous rising curve to shut-off is facilitated.

Figure 5A:
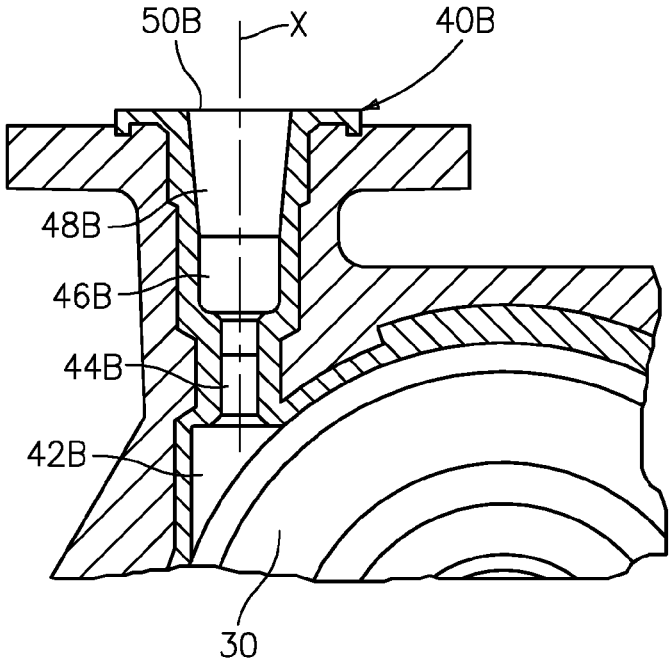
FIG. 5A is a partial lateral sectional view of a centrifugal pump assembly illustrating another non-limiting embodiment of a nozzle according to the present disclosure.
Figure 5B:
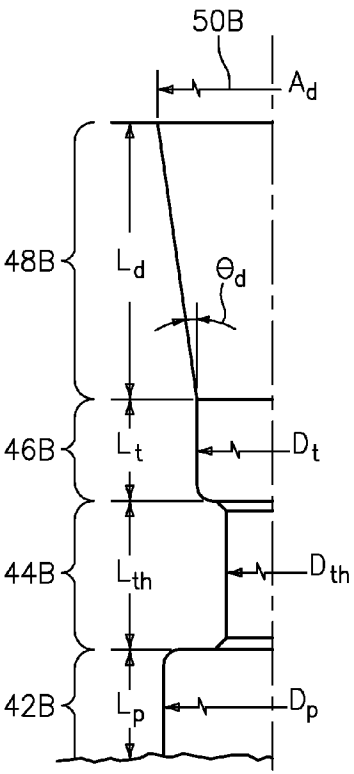
FIG. 5B is an expanded lateral sectional view of the centrifugal pump assembly illustrated in FIG. 5A.

Referring to FIG. 5A, another non-limiting embodiment of the nozzle 40 may be a nozzle 40B that generally defines a pocket section 42B, a throat section 44B, a transition section 46B, and a diffuser section 48B along axis X. The transition section 46B is generally stepped out to diameter Dt from the throat section 44B diameter Dth (FIG. 5B). The nozzle 40B defines a discharge 50B.

Figure 6:
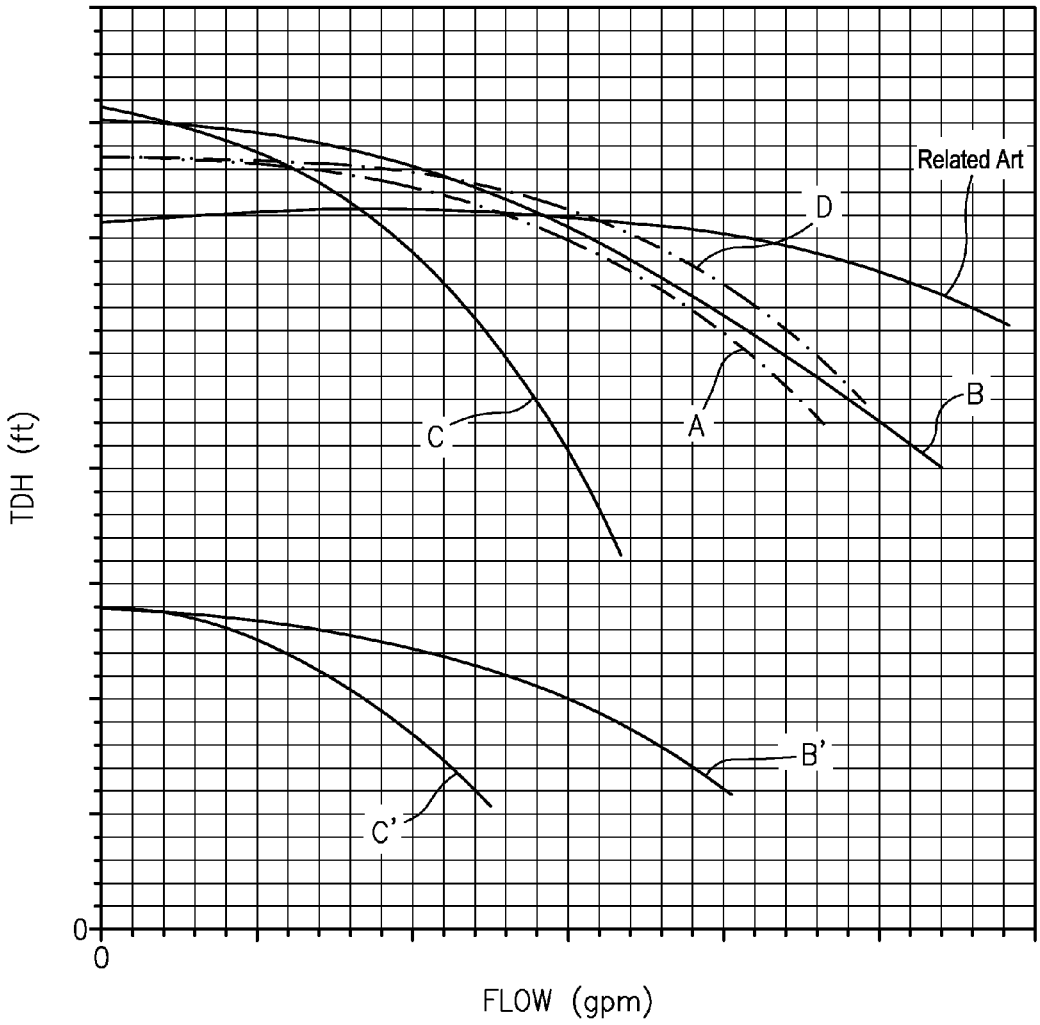
FIG. 6 is a Total Dynamic Head (TDH)/Flow curve of the nozzles of FIGS. 4, 5 and 8 as compared to the RELATED ART nozzle of FIG. 3.

Referring to FIG. 6, nozzle 40A provides a Total Dynamic Head (TDH)/Flow curve (A) that is stable and rising to shut-off but tends to flatten off a bit at a lower TDH value compared to nozzle 40B (curve (B)). The diameter and length of the throat sections 44 change the (TDH)/Flow curve shape but the curve remains stable.

Figure 7B:
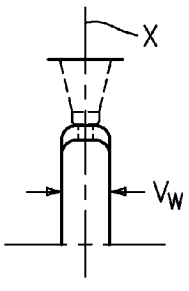
FIG. 7B is a longitudinal dimensional relationship of the centrifugal pump assembly illustrating the pocket section of the nozzle relative to a volute width.
Figure 7A:
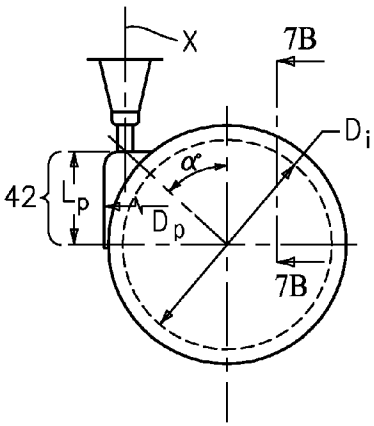
FIG. 7A is a lateral dimensional relationship of the centrifugal pump assembly illustrating a pocket section adjacent to the nozzle according to the present disclosure.

The pocket section 42 defines a pocket height $L_p$ defined by angle $\alpha$ between the pump axis of rotation Y and the intersection between the pocket section 42 and the throat section 44 along axis X (FIG. 7A). In general, the pocket section 42 stabilizes the curve shape at shut-off. In one non-limiting embodiment, the pocket section diameter $D_p$ is less than or equal to the Volute Width $V_w$ (FIG. 7B).

The throat section diameter $D_{th}$ generally controls the desired operating curve such that a reduction in the throat section 44 diameter results in a steeper curve (C). In one embodiment, the throat section diameter $D_{th}$ is less than $D_p$.

The shape of the transition section 46 also affects the curve shape. For example, a stepped transition section 46B (FIG. 5A) increases the shut-off head and steepens the curve shape (see curve B) while an angled (gradual) transition section 46A (FIG. 4A) generally reduces the shut-off head and flattens the curve but remains stable. In one embodiment, the transition section 46A diameter: Dt≈(1.6 to 2.1)Dth.

A transition section length $L_t \approx 0.55\ L_d - L_{th}$.

Where:

$L_d$ is diffuser section length.

$L_{th}$ is throat section length.

A reduction in the impeller diameter, also called trimming, retains the curve shape at lower TDH values (see curve C' and curve B'). The performance characteristic may thus be maintained for various impeller diameters.

Figure 8:
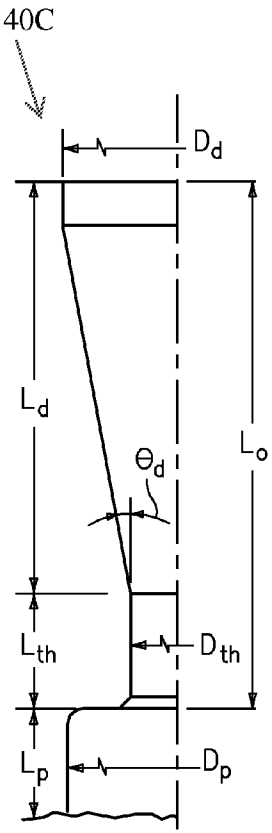
FIG. 8 is a partial lateral sectional view of a centrifugal pump assembly illustrating another non-limiting embodiment of a nozzle according to the present disclosure.

Elimination of the transition section ($L_t$=0; FIG. 8) results in a reduced shut-off with a relatively flatter shape that delivers more flow. Drop-off occurs at higher flow rates (see curve D). The throat section length $L_{th}$ is affected by the requirement to maintain an appropriate diffuser section length $L_d$ and a diffuser section angle $\theta_d$ of approximately 5-7 degrees to match the discharge diameter $D_d$.

The diffuser section 48 generally converts velocity head into pressure. The typical diffuser section 48 defines an included angle of 2θd. For a nozzle 40 with a transition section 46 (FIGS. 4 and 5), the included angle would be approximately 10 to 11 degrees. For a nozzle 40C without a transition section (FIG. 8), the included angle could be up to approximately 14 degrees.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A flow outlet for a pump comprising:

a pocket section defined by a pocket section diameter, a pocket section length, and a volute width extending in a direction transverse to said pocket section diameter; and a throat section downstream of said pocket section, said throat section defined by a throat section diameter and a throat section length, said throat section diameter being less than said pocket section diameter, and wherein said pocket section length is defined by an angle between a pump axis of rotation and an intersection between the pocket section and the throat section along an outlet axis defined by the throat section, and wherein said pocket section diameter is less than or equal to said volute width of the pocket section, and wherein said throat section diameter is less than or equal to approximately 0.3 times said pocket section diameter.

2. The flow outlet as recited in claim 1, wherein said flow outlet is defined along an axis transverse to an axis of rotation of an impeller.

3. The flow outlet as recited in claim 1, further comprising a transition section downstream of said throat section, said transition section defining a stepped transition section.

4. The flow outlet as recited in claim 1, further comprising a transition section downstream of said throat section, said transition section defining an angled transition section.

5. The flow outlet as recited in claim 1, further comprising a transition section downstream of said throat section, said transition section defining a transition section diameter that is approximately 1.6 to 2.1 times said throat section diameter.

6. The flow outlet as recited in claim 1, further comprising a transition section downstream of said throat section, wherein a transition section length ($L_t$) is defined by $L_t \approx 0.55 L_d - L_{th}$ where $L_{th}$ is throat section length and $L_d$ is a diffuser section length of a diffuser section downstream of said transition section.

7. The flow outlet as recited in claim 6, wherein sides of said diffuser section define a diffuser section angle.

8. The flow outlet as recited in claim 1, wherein said pocket section and said throat section are formed within a single-piece nozzle that is positioned within the flow outlet.

9. The flow outlet as recited in claim 8, wherein said single-piece nozzle includes a transition section downstream of said throat section, and includes a diffuser section downstream of said transition section.

10. The flow outlet as recited in claim 1, wherein said pocket section diameter is less than said volute width of the pocket section.

11. A centrifugal pump comprising:

a housing which defines a collector;

an impeller within said collector, said impeller having an axis of rotation;

a pocket section adjacent to said collector, said pocket section defining a pocket section diameter; and a throat section downstream of said pocket section, said throat section defining a throat section diameter less than said pocket section diameter, and wherein said throat section diameter is less than or equal to approximately 0.3 times said pocket section diameter.

12. The centrifugal pump as recited in claim 11, wherein said pocket section is formed in the housing of the pump.

13. The centrifugal pump as recited in claim 12, wherein said throat section is formed within a nozzle, said nozzle mounted within said housing.

14. The centrifugal pump as recited in claim 11, further comprising a transition section downstream of said throat section.

15. The centrifugal pump as recited in claim 14, further comprising a diffuser section downstream of said transition section.

16. The centrifugal pump as recited in claim 11, wherein said pocket section defines a pocket length defined by an angle between the axis of rotation and an intersection between the pocket section and the throat section along an outlet axis defined by the throat section.

17. The centrifugal pump as recited in claim 16, wherein the pocket section diameter is less than or equal to a volute width of the pocket section, said volute width being defined in a direction that is transverse to said pocket length and said pocket section diameter.

18. The centrifugal pump as recited in claim 17, wherein said pocket section diameter is less than said volute width of the pocket section.

19. The centrifugal pump as recited in claim 11, further comprising a transition section downstream of said throat section, said transition section defining a transition section diameter that is approximately 1.6 to 2.1 times said throat section diameter.

20. The centrifugal pump as recited in claim 19, wherein a transition section length ($L_t$) is defined by $L_t \approx 0.55L_d - L_{th}$ where $L_{th}$ is throat section length and $L_d$ is a diffuser section length of a diffuser section downstream of said transition section.

21. The centrifugal pump as recited in claim 20, further comprising a diffuser section downstream of said transition section, said diffuser section defining a diffuser section angle of approximately five to seven degrees.

22. The centrifugal pump as recited in claim 11, wherein said pocket section and said throat section are formed within a single-piece nozzle that is positioned within a flow outlet of said housing.

23. The centrifugal pump as recited in claim 22, wherein said single-piece nozzle includes a transition section downstream of said throat section, and includes a diffuser section downstream of said transition section.

24. The centrifugal pump as recited in claim 11, wherein said housing defines an interior cavity, and including an inner magnet assembly positioned within said interior cavity and an outer magnet assembly positioned external to said housing, said outer magnet powered by a motor to rotate said impeller via said inner magnet assembly.

* * * * *